United States Patent [19]

Barone et al.

[11] Patent Number: 4,705,644

[45] Date of Patent: Nov. 10, 1987

[54] ALPHA-SULFO-HIGHER FATTY ACID-LOWER ALCOHOL ESTER- AND AMIDE-BASED DETERGENT LAUNDRY BARS AND PROCESS FOR MANUFACTURE THEREOF

[75] Inventors: Patrizia Barone, Piscataway; Pallassana N. Ramachandran, Robbinsville, both of N.J.

[73] Assignee: Colgate Palmolive Company, New York, N.Y.

[21] Appl. No.: 836,909

[22] Filed: Mar. 6, 1986

[51] Int. Cl.[4] ..... C11D 17/00

[52] U.S. Cl. ..... 252/135; 252/134; 252/140; 252/174; 252/174.14; 252/174.25; 252/531; 252/532; 252/545; 252/550; 252/551

[58] Field of Search ..... 252/134, 135, 531, 139, 252/140, 154, 163, 174, 174.25, DIG. 16, 530, 532, 535, 538, 549, 551, 553, 557, 545

[56] References Cited

U.S. PATENT DOCUMENTS

| | | | |
|---|---|---|---|
| 3,442,812 | 5/1969 | Barnhurst et al. | 252/535 |
| 4,011,170 | 3/1977 | Pickin et al. | 252/134 |
| 4,265,778 | 5/1981 | Sonenstein | 252/DIG. 16 |
| 4,472,287 | 9/1984 | Ramachandran et al. | 252/174.25 |
| 4,543,204 | 9/1985 | Gervasio | 252/DIG. 16 |

*Primary Examiner*—Paul Lieberman
*Assistant Examiner*—Hoa Van Le
*Attorney, Agent, or Firm*—Herbert S. Sylvester; Murray M. Grill; John A. Stemwedel

[57] ABSTRACT

Detergent laundry bars which are mild to the hands of a user, of good foaming properties during hand washing of laundry and of good processing characteristics, include 10 to 30% of water soluble salt of alpha-sulfo-higher fatty acid-lower alcohol ester, 10 to 50% of builder for such detergent, a bodying proportion, in the range of 20 to 70%, of water insoluble powder and/or sodium sulfate filler, and 5 to 20% of water. Preferably, this improved detergent laundry bar includes 18 to 22% of sodium alpha-sulfo-higher fatty acid methyl ester, 8 to 20% of sodium tripolyphosphate, 5 to 15% of sodium carbonate, 2 to 5% of sodium silicate, 20 to 35% of calcium carbonate, 5 to 15% of talc and 10 to 15% of water. Also within the invention is a process for manufacturing such detergent laundry bars wherein the components of the laundry bar composition which are in powder form are all pre-mixed, followed by admixing, with the pre-mix, of liquid components of the detergent composition, including sodium silicate, in aqueous solution, water and perfume, in that order, and the mixture is amalgamated, milled, plodded under vaccum, cut to desired lengths and pressed to desired form.

15 Claims, No Drawings

ALPHA-SULFO-HIGHER FATTY ACID-LOWER ALCOHOL ESTER- AND AMIDE-BASED DETERGENT LAUNDRY BARS AND PROCESS FOR MANUFACTURE THEREOF

This invention relates to detergent laundry bars. More particularly, it relates to a built detergent laundry bar in which the detergent comprises alpha-sulfo-higher fatty acid-lower alcohol carboxylic acid ester and/or amide. Such bars, containing such detergent are mind to the hands of a user, and of good processing characteristics, and are superior in such respects and in other desirable properties, too, to various other built synthetic organic detergent laundry bars. For example, the invented bars are more readily milled, plodded and pressed to shape than bars of similar formulas based on higher fatty alcohol sulfate detergent, and they are not as subject to cracking, chipping, breaking or other damage on storage and during handling and transportation, as such alkyl sulfate bars.

Soap bars have for long been employed for washing the human body and for "doing laundry". Before the advent of washing machines dictated the employment of detersive materials in powder, disintegrable briquette, or liquid forms, laundry was washed with "laundry soap" bars made from suitable soaps of higher fatty acids, such as sodium soaps of mixed tallow and rosin fatty acids. Such laundry soap bars were especially suitable for being rubbed onto badly stained or soiled portions of fabric being laundered, as on a washboard, to deposit a high concentration of the soap on the soiled area, and they provided mechanical means for applying energy to such surfaces to assist in removing the stains and soils.

Despite the fact that after introduction of synthetic organic detergents and washing machines the amount of soap employed for laundry use diminished greatly, with the soap-based laundry bars being replaced mostly by synthetic organic detergent compositions in powder, liquid or other suitable form, laundry soaps and detergents in bar form are still preferred by some consumers, especially in certain areas of the world. Several detergent laundry bars based on alkylbenzene sulfonate detergents have been successfully marketed. They have been characterized as the equivalents in detersive action of powdered laundry detergents based on similar alkylbenzene sulfonates, and are considered by many consumers to be more convenient to use. To use them does not require a washing machine and, as was previously indicated, the bar form of the product allows it to be used in such manner that a comparatively high concentration of detersive material may be readily applied to a heavily stained or soiled area with accompanying physical force or energy, as on a washboard, so as more readily to loosen and remove such soil or stain.

Although branched chain higher alkylbenzene sulfonate detergents, such as sodium dodecylbenzene sulfonate (the dodecyl is often highly branched propylene tetramer but can be less branched too), make satisfactory detergent laundry bars, such detergents have sometimes been found to be environmentally, ecologically, or economically unacceptable, and accordingly efforts have been made to formulate detergent laundry bars based on other synthetic organic detergents which would be less objectionable or would be unobjectionable in such respects. Among candidates for use as such a detergent are the higher fatty alcohol (or alkyl) sulfates, especially the sodium salts, which are biodegradable and have been successfully employed in various other detergent compositions. However, such higher fatty alkyl sulfates had been found to be susceptible to becoming damaged during handling after storage and before final use. It was observed that they appeared to change physical properties after manufacture and became prone to excessive breakage during ordinary shipment. Additionally, such products were often not as satisfactorily foaming as was desired. One solution to breakage problems is disclosed in U.S. Pat. No. 4,543,204, which teaches the incorporation of higher fatty acids in a bar formula to counteract the tendency of higher fatty alcohol sulfate laundry bars to crack or break during storage and shipment, and also mentions that the fatty acid improves foaming characteristics of the fatty alcohol sulfate bars. However, that requires the addition of material to the formula which is not a detergent or a builder, and which may be comparatively expensive. The present invention is of a detergent laundry bar of acceptable laundry bar properties (foaming, detergency, processing ease and mildness), which is environmentally acceptable (biodegradable), and which does not crack or break to an excessive extent on storage and during shipment.

In accordance with the present invention a detergent laundry bar of good mildness, foaming properties for hand washing of laundry, and processing characteristics, comprises 10 to 30% of water soluble salt of alpha-sulfo-higher fatty acid-lower alcohol ester and/or -amide, 10 to 50% of builder for the detergent, a bodying proportion, in the range of 20 to 70%, of water insoluble powder and/or sodium sulfate filler, and 5 to 20% of water, which water includes water removable from any hydrate components of the detergent laundry bar when such bar is subjected to heating at 105° C. for two hours. Preferably the detergent laundry bar comprises 18 to 22% of sodium alpha-sulfo-higher fatty acid-methyl ester and/or -amide or N-methyl amide wherein the acid is a mixture of fatty acids of carbon atom contents in the range of 8 to 20, 8 to 20% of sodium tripolyphosphate, 5 to 15% of sodium carbonate, 2 to 5% of sodium silicate, 20 to 35% of calcium carbonate, 5 to 15% of talc and 10 to 15% of water. Also within the invention is a process for manufacturing a detergent laundry bar of the invention which comprises pre-mixing together 10 to 30 parts of water soluble salt of alpha-sulfo-higher fatty acid-lower alcohol ester and/or amide, 10 to 50 parts of a builder for the detergent, a bodying proportion, in the range of 20 to 70 parts, of water insoluble powder and/or sodium sulfate filler, all of which materials, with the optional exception of any sodium silicate present, are in finely divided particulate form, mixing said pre-mix with 5 to 20 parts of water, plodding the mixture, extruding it in bar form and cutting the bar to desired lengths. The 5 to 20 parts is total mix water content.

The manufacture of alpha-sulfo-higher fatty acid lower alcohol esters is described in detail in the Journal of the American Oil Chemists' Society, Vol. 55, pages 549–557, and at page 557 such materials are taught to be components of detergent compositions and soap-detergent bars. Granular detergent compositions containing alpha-sulfo-higher fatty acid lower alcohol esters are described in Japanese Pat. Nos.59020395 and 59221394. Belgian Pat. Nos. 638,341 and 648,340 describe soap-detergent bars containing such an alpha-sulfo-fatty acid ester as a detersive component. However, none of the references anticipates or makes obvious the subject matter of the present invention, built detergent laundry bars based on such alpha- sulfo-fatty acid esters and/or amides.

The alpha-sulfo-higher fatty acid-lower alcohol ester and/or amide of this invention is preferably employed as water soluble salt(s), such as the sodium salt(s). However, other alkali metal salts, such as those of potassium, may be employed, as may be suitable ammonium, magnesium, calcium and lower alkanolamine salts, e.g., ethanolamine salts.

The alpha-sulfo-higher fatty acid esters utilized in this invention are of the formula

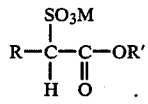

wherein R is higher fatty alkyl or alkenyl and R′ is lower alkyl. R will normally be of 6 to 18 carbon atoms, so that the higher fatty acid moiety, of which it is a part, will be of 8 to 20 carbon atoms. R′ will normally be of 1 to 4 carbon atoms but preferably will be of 1 to 3 carbon atoms, more preferably of 1 to 2 carbon atoms, and most preferably will be methyl. As was indicated before, M can be any of various suitable cations but will very preferably be sodium. It is noted that in the alpha-sulfo-fatty acid esters employed in making the detergent laundry bars of this invention the salt is of the sulfonic acid moiety and the ester is of the carboxylic acid moiety of the alpha-sulfo-fatty acid. The alpha-sulfo-higher fatty amides of the invention are of the formula

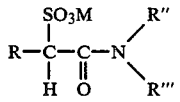

wherein R″ and R‴ are hydrogen or alkyl of 1 to 4 carbon atoms, preferably hydrogen or alkyl of 1 to 3 carbon atoms and more preferably hydrogen or alkyl of 1 or 2 carbon atoms. R and M are the same as described for the ester formula previously given.

The higher fatty acids from which the alpha-sulfo-higher fatty acid-lower alcohol ester and/or the amide is/are made are naturally occurring materials and can be produced by hydrolysis of other suitable reactions of triglycerides (fats and oils). Unlike some petroleum-derived alkyl and alkenyl moieties, the fatty acid chains of the principal detergents of the present compositions are readily biodegradable. Among sources of fatty acids useful for the manufacture of the present principal detergents are coconut oil, tallow, palm kernel oil, palm oil and palm stearin, but other oils capable of yielding fatty hydrocarbyl moieties of the types described may be substituted, at least in part. If desired, such oils may be hardened (hydrogenated) beforehand or the fatty acids may be hardened to increase saturation. The fatty acids and the fatty acid moieties of the oils and/or fats from which they are obtained are of carbon atom contents in the range of 8 to 20 and such fatty acids may include mixtures of fatty acids in different proportions over such range. In some cases narrower cuts of fatty acids may be employed, such as those of progressively narrower carbon contents in the ranges of 10 to 20, 12 to 18 and 14 to 16. Sometimes a particularly narrow cut, e.g., lauric acid, myristic acid, or palmitic acid, may be preferred for best use characteristics of the detergent laundry bar containing the methyl ester of alpha-sulfo-higher fatty acid and/or the corresponding amide wherein R″ and R‴ are hydrogen and/or alkyl of 1 or 2 carbon atoms.

Other synthetic organic anionic detergents of the sulfated and/or sulfonated types (and in some case nonionic and/or amphoteric detergents) may also be present in the laundry bar as secondary detergents but the total amounts of such secondary detergents will normally be only minor, with respect to the amount of the principal detergent, alpha-sulfo-fatty acid ester and/or amide, which is present. Among the secondary detergents those which are preferred, especially when biodegradability is desirable, include the higher fatty acid monoglyceride sulfates of 10 to 18 carbon atoms in the fatty acyl moieties, the paraffin sulfonates, olefin sulfonates, higher fatty alcohol sulfates of 10 to 18 carbon atoms, and sulfated ethoxylated higher fatty alcohols of 10 to 18 carbon atoms and 1 to 10 ethoxy groups. Sometimes some branched and linear alkylbenzene sulfonates, of 10 to 18 carbon atoms in the lipophilic groups thereof, may be present, with the more biodegradable members of the alkylbenzene sulfonate class being more preferred. The higher fatty acid soaps may also be incorporated in these products, but only in minor proportions, and mixtures of the various secondary detergents with each other and/or with soaps (and/or with the principal alpha- sulfo-higher fatty acid-lower alcohol ester and/or amide detergent) may be utilized. Higher fatty acid lower alkanolamides, such as monoethanolamides and diethanolamides, preferably of coconut oil fatty acids, may also be included in the present detergent laundry bars but although such possess some detersive properties they will usually be employed because of their functions as improvers of other laundry bar properties, such as foam quantity and quality. The various secondary detersive components of the laundry bars will normally be employed as their water soluble salts, and preferably will be sodium salts. Mixtures of different types of salts may be employed, as may be mixtures of the detergents. Normally the higher fatty acyl and/or the alkyl groups in the detergents will be mixtures but essentially pure starting materials may also be employed so that the detergents, whether primary or secondary detersive component of the product, may include lipophilic groups of essentially the same chain length.

Various water soluble builder salts, usually as sodium salts, may be incorporated in the invented laundry bars. Of these the most important are the phosphates, particularly the polyphosphates, such as sodium tripolyphosphate and sodium pyrophosphate. Sodium orthophosphate may be employed, usually in minor proportion with respect to the polyphosphate(s). Other builder salts, of the chelating or precipitating types, inorganic and organic, may also be used, such as sodium carbonate, sodium silicate, normally of $Na_2O;SiO_2$ ratio in the range of 1:2 to 1:3, and more preferably 1:2 to 1:2.4, borax, and sodium bicarbonate. Other builders, including organic builders, such as trisodium nitrilotriacetate (NTA), sodium polyacrylate, sodium citrate and sodium polyacetal carboxylate, may be used, as may be other water soluble salts of the corresponding acids.

In addition to the water soluble builders, some water insoluble builders may also be employed, such as detergent building calcium ion exchanging zeolites, including hydrated zeolites, A, X and Y, e.g., Zeolite 4A containing about 20% of water of hydration. Such materials also may act as bodying agents and can improve processability but while such other desirable properties can be of some importance, herein the zeolites will be considered as builders, and will be included in the proportions specified for builders.

Various mixtures of builders may be employed to make the laundry bars of this invention but it is preferable that the primary builder be hydrated pentasodium tripolyphosphate, high in Type I crystal form. It has been found that such hydrated polyphosphate, which preferably is hydrated during working in with the other detergent laundry bar components, contributes substantially to improvements in ease of working, strength and uniform extrusion of the present laundry detergent bars. In addition to functioning as a builder, the sodium silicate acts as a binder for the other components, and helps to prevent corrosion of aluminum and other metals by the detergent bar. Sodium carbonate has bodying properties too, as does borax.

Water insoluble particulate material components of the present bars, hereafter usually referred to as bodying agents, although they may also perform other functions in the bars, contribute significantly to the formation of a firm, yet processable laundry bar, and help to regulate the release of detergent from the bar during use. While any of many insoluble materials, usually inorganic and mineral, may be employed, such as clays, talc, calcium silicate, magnesium silicate, calcium sulfate, silica, calcium phosphate, and calcium carbonate, the most important of such materials is calcium carbonate, and talc is usually considered to be the next best such bodying agent. Talc, a natural hydrous magnesium silicate, is especially useful for promoting processing ease, improving the feel of the laundry bar, helping to improve its storage characteristics and making a better foam or lather, in conjunction with the other components of the bar. Bentonite, preferably as sodium bentonite, may also be used and has the advantage of performing as a fabric softening agent for the washed laundry. It can also can act as a processing aid.

The calcium carbonate, talc, bentonite and the other insolubles(and often soluble materials, too) will normally be in finely divided form, often with all or substantially all, e.g., over 99%, passing through a No. 200 sieve (U.S. Sieve Series) and sometimes through a No. 325 sieve.

Instead of the mentioned insoluble bodying agents it has been found that sodium sulfate, which is water soluble, may be employed, preferably of particle sizes like those given in the preceding paragraph, and often mixed with the insoluble bodying agents.

Various adjuvants may be employed in the present detergent laundry bars for their individual desirable effects. Among such adjuvants are: foam stabilizers, such as higher fatty acid lower alkanolamides, e.g., coco monoethanolamide, lauric myristic diethanolamide, coco diethanolamide; binders, such as starches and modified starches; plasticizers, such as higher fatty acids, e.g., lauric and myristic acids, and higher fatty alcohols, e.g., cetyl alcohol and lauryl alcohol; hardening agents, e.g., glycerol; colorants, such as dyes and pigments, e.g., Polar Brilliant Blue dye and ultramarine blue pigment; fluorescent brighteners, such as stilbene brighteners; whitening agents, such as titanium dioxide (anatase); antioxidants, e.g., benzohydroxytoluene; perfumes, anti-redeposition agents, e.g., sodium carboxymethylcellulose (which also may have binding properties); buffering agents, especially complexing acids, e.g., citric acid, tartaric acid, and boric acid, and mixtures thereof; enzymes, e.g., protease, amylase; bactericides; fungicides, and solvents.

In addition to the above components water will be present in the laundry bar. It may accompany other components as a solvent or dispersion medium for them or it may be added. While it is preferred to employ deionized water, tap water or city water may be utilized, preferably with the hardness content thereof being no more than 200 parts per million, as calcium carbonate, and more preferably with such hardness being less than 100 or 50 p.p.m. The water serves as a mutual solvent and plasticizing agent for various components of the detergent bar and facilitates hydration of some of the hydratable materials, such as sodium polyphosphate, sodium pyrophosphate, sodium carbonate, sodium sulfate, bentonite and starch (when present). In conjunction with detergents, binders, bodying agents and/or hydratable salts present, plus some adjuvants, the water tends to facilitate processing, such as milling and plodding, and helps to maintain the detergent bar sufficiently strong so that it will resist cracking and breakage on shipment after manufacture and storage. It appears that any higher fatty acid or higher fatty alcohol present may inhibit evaporation of moisture from the laundry bar, thereby helping to keep the bar in stronger condition on storage. The alkanolamides and any other fatty adjuvants present can also have such an effect.

The proportions of the various components in the final detergents are approximately the same as those in the mixture of materials being formulated (usually in an amalgamator) for milling and plodding because relatively little moisture is lost in such operations. Normally the moisture loss will be between 0.5 to 3%, and most of the time the loss will be between 1 and 2%, e.g., 1.5%. If it appears during the mixing or subsequent operations that the composition is insufficiently plasticized due to low water content, additional water may be employed, which is usually added to the amalgamator, sigma-type mixer or other suitable mixing or blending device, with the various other components of the laundry bar.

The final bar will have a total content of alpha-sulfo-higher fatty acid-lower alcohol ester and/or amide which will be in the range of 10 to 30%, preferably 15 to 25%, and more preferably 18 to 22%, e.g., 20%. No other type of detergent has to be present but sometimes up to 5 or 10% of an auxiliary detergent may be employed, e.g., sodium higher fatty alcohol sulfate or sodium higher fatty alcohol ethoxylate sulfate, which may or may not be in replacement of a minor proportion of the principal detergent, alpha-sulfo-fatty ester and/or amide.

The builder content will normally be in the range of 10 to 50%, preferably 15 to 40%, and sometimes more preferably about 25%, and it will often be preferred that the builder be inorganic water soluble salt, such as a mixture of sodium tripolyphosphate, sodium carbonate and sodium silicate ($Na_2O:SiO_2 = 1:2.4$). The percentage of bodying agent present will normally be in the range of 20 to 70%, preferably 20 to 50% and often more preferably 20 or 30 to 35 or 40%. The ranges of percentages of water in the bar, which includes water removable from any hydrate components when the bar is subjected to heating at 105° C. for two hours, following a normal moisture analysis procedure, will normally be 5 to 20%, preferably 7 to 17%, more preferably 10 to 15%, and sometimes most preferably 12 %. With respect to individual builders and bodying agents it may be preferred that the builders include 5 to 35% of sodium tripolyphosphate, 0 to 25% of sodium carbonate and 0 to 10% of sodium silicate, more preferably 8 to 20%, 5 to 15%, and 2 to 5%, respectively, e.g., about 12% of sodium tripolyphosphate, about 10% of sodium carbonate and about 4% of sodium silicate. The bodying agent, preferably water insoluble powder, will preferably comprise 20 to 35% of calcium carbonate and 5 to 15% of talc, more preferably about 28% of calcium carbonate and about 11% of talc.

Adjuvant content will usually be limited to 5% and preferably will be limited to 3%. Thus, the proportion of adjuvants present may be in the range of 0 or 0.5 to 3 or 5%. e.g., about 1 or 2%.

The invented detergent laundry bars can be processed with available equipment of types used for manufacturing soap and detergent bar products. Initially, a heavy duty amalgamator or mixer, such as one equipped with sigma-type blades or one equipped with counter-rotating paddle type agitators, is used to mix the various powdered or particulate components. The order of addition of the solid components of the laundry bars is not considered to be important, but it is preferable (to assist in preventing lumping and heterogeneous mixing) to add the liquid components after the powdered ones. Usually it will be preferred for best mixing and rapid production of a homogeneous product, to admix the formula proportion of the silicate, usually as a 40.5% solids aqueous solution when $Na_2O:SiO_2$ =about 1:2.4, with the previously mixed powders, followed by any water and perfume. Care should be taken to prevent complete or premature hydration of the phosphate (and any other hydratable components which desirably hydrate during working of the composition), which premature hydration could cause excessive lumping during the mixing process. The mixing may take only a short time, but can take from one minute to an hour, with the usual mixing time being from 2 to 15 minutes. The mixed product will desirably be in separable solid form at about room temperature and will be charged, preferably by means of a multi-worm transfer conveyor (preferably equipped with cooling means), to a multi-rolled mill, such as a five-roll Lehmann mill of the soap mill type. The mill will be equipped with means for heating or cooling and normally the cooling means will be employed to maintain the ribbon temperature from the mill within the range of about 30 to 40 or 45° C. Various ribbon and chip thicknesses may be employed but usually such thicknesses will be in the range of 0.1 to 1 mm., preferably 0.2 to 0.4 or 0.5 mm. However, other thicknesses may be employed, depending on particular formulations being milled, so long as the composition is satisfactorily homogenized on the mill and providing that any coarse particles that may be present are pulverized so that the finished product is not objectionably gritty.

The milled chips or milled material in other form is then conveyed to a double stage vacuum plodder, operating under a vacuum, e.g., 600 to 740 millimeters of mercury vacuum, in which any entrapped air is evacuated. Sometimes milling may be omitted and the amalgamated composition may be passed directly to the plodder. The mass of laundry detergent composition is worked in the plodder and is extruded from it as a bar. The plodder is equipped with a heated nozzle which softens the composition immediately prior to extrusion, allowing the production of a uniform and homogeneous bar. Such bar may be cut to length and impressed with a product brand name by means of a combination of rotary cutter and imprinter, or it may be cut to lengths, called blanks, and may be stamped to shape in a press. Before pressing, the blanks may be cooled in a cooling tunnel. If not to be pressed, the cut lengths are cooled before wrapping. In either case the cooled bars are automatically wrapped, cased and sent to storage, prior to shipement.

Following another manufacturing method the detergent composition is crutched, spray dried and plodded and/or pressed to bar form.

The milled and plodded detergent laundry bars made in accordance with this invention have properties that are superior to those of detergent laundry bars based on other synthetic organic detergents, such as the higher fatty alcohol sulfates and the alkylbenzene sulfonates. They are mild to the hands and are especially good scum dispersants. Also, they wash and foam satisfactorily when employed as bar detergents for hand washing of laundry. They are readily processable in commercial milling, plodding and processing equipment, and the product withstands shipment and handling without breakage.

From this description it is seen that the various components of the laundry bars interact and contribute to the final desirable properties of the product in several ways. The result is that an improved synthetic organic detergent laundry bar of properties acceptable for commercial marketing has been made, based on alpha-sulfo-higher fatty acid-lower alcohol ester and/or the corresponding alpha-sulfo-higher fatty acid amide. The following examples are given to illustrate the invention but are not to be considered as limiting it. Unless otherwise indicated, all temperatures are given in ° C. and all parts and proportions are by weight in the examples, the specification and claims.

| Component | Percentage |
|---|---|
| Alpha-sulfo-higher fatty acid[1]-methyl ester, sodium salt | 20.0 |
| Sodium tripolyphosphate[2] | 12.0 |
| Talc, powdered (through No. 200 sieve, U.S. Sieve Series) | 11.0 |
| Calcium carbonate, powdered (through No. 200 sieve, U.S. Sieve Series) | 28.2 |
| Sodium carbonate, anhydrous | 10.0 |
| Sodium silicate[3] | 3.5 |
| Coco monoethanolamide | 2.0 |
| Sodium carboxymethylcellulose | 0.5 |
| Perfume | 0.3 |
| Optical brightener (stilbene type) | 0.2 |
| Pigment, white (titanium dioxide, finely powdered) | 0.3 |
| Blue dye | 0.03 |
| Water[4] | 14.0 |
| water loss in processing | 2.0 |
| | 100.0 |

[1]Mixed $C_{8-20}$ fatty acids, as from coconut oil
[2]High in Phase I content (50% or more)
[3]Sodium silicate content of 40.5% aqueous solution
[4]Includes 5.1% of water from sodium silicate solution Detergent laundry bars of the formula given (with 2% extra water to compensate for that lost in processing) are made by a process which includes the steps of mixing, milling, plodding, cutting to lengths and pressing to shape. Mixing is effected in a conventional soap or detergent amalgamator or mixer having a sigma-type mixing blade. The various solid components, all in powder form with major proportions thereof less than No. 12 sieve, U.S. Sieve Series, are mixed together in the amalgamator at room temperature (25° C.), followed by addition of the sodium silicate (in aqueous solution), water (in which the dye is present in solution), and perfume. The mixing operation takes only a short time, about five minutes, which is desirable to inhibit complete hydration of the polyphosphate. The contents of the mixer are fed by a multi-wormed conveyor to a five-roll mill of the Lehmann type, wherein the mix is converted to ribbon and chip form. The multi-worm transfer conveyor is equipped with cooling means to prevent any undesirable sticking of the mixture to the conveyor parts.

The mill, which is also equipped with cooling means, operates at such a temperature that the final chip is at a suitable temperature, in the range of about 35° C. to 42° C., but in some instances higher or lower temperatures may be employed. The chip thickness is maintained in the range of 0.2 to 0.4 mm. The milled chips are then fed to a double stage vacuum plodder, which operates at a vacuum of about 700 mm. of mercury, to remove any entrapped air, to work the composition and to extrude it as a bar through a heated nozzle, wherein the composition is heated sufficiently to facilitate extrusion as a homogeneous bar. The bar is then cooled to a suitable pressing temperature, in the range of 20° C. to 30° C., and is pressed to a final bar or cake shape, following which it is automatically wrapped, cased and sent to storage, for subsequent shipment and sale to the ultimate consumer. Alternatively, instead of being pressed to shape, the bars may be cut or essentially simultaneously cut and "printed" with a company name or other indicia, in which case the mentioned cooling may be effected after cutting and/or "imprinting".

The bars made, when employed for the handwashing of laundry, utilizing a scrubbing board, are effective detergents and foam well. They are considered to be acceptable in these respects for commercial marketing and the satisfactory foaming ability thereof is verifiable by a foaming test which measures initial foam, persistence of foam and refoaming capability, simulating handwashing operations. The bar is especially mild to the hands of the user, little or no "soap scum" is formed in the washing vessel, and no such scum adheres to the washed laundry. The bars process well and do not crack, chip, break or crumble under conditions that simulate normal shipment and storage before use. Similar results are obtained when the

| Component | Percentage |
|---|---|
| Sodium alpha-sulfo-$C_{8-20}$ higher fatty acid primary amide | 20.0 |
| Sodium tripolyphosphate | 12.0 |
| Talc | 11.0 |
| Calcium carbonate | 31.5 |
| Sodium carbonate | 10.0 |
| Sodium silicate | 3.5 |
| Water | 14.0 |
| water loss in processing | 2.0 |
| | 100.0 |

When a detergent laundry bar of the above formula is made by the process of Example 1, a product of comparable satisfactory characteristics may be produced. Such is also the result when the principal detergent is sodium alpha-sulfo-$C_{8-20}$ higher fatty N,N-dimethyl amide, a 1:1 mixture (by weight) of sodium alpha-sulfo-$C_{8-20}$ higher fatty acid methyl ester and sodium alpha-sulfo-$C_{8-20}$ higher fatty acid primary amide, or a 3:1 (by weight) mixture of such primary amide salt and the corresponding N,N-dimethyl amide sodium salt or corresponding N,N-diethyl amide sodium salt.

EXAMPLE 4

When in the preceding examples, the proportions of the various components of the invented formulas are varied ±10% and ±25%, while being maintained within the ranges given in the specification, satisfactory detergent laundry bars, having the previously described favorable properties, are also obtainable. Similarly, when other builders, such as sodium NTA, sodium citrate, polyacetal carboxylate and borax, are employed in partial replacements, e.g., up to ½, of the sodium tripolyphosphate and sodium carbonate, acceptable detergent laundry bars having the desirable properties mentioned are obtainable. Such is also the case when up to ⅓ of the calcium carbonate is replaced by sodium sulfate. Alternatively, bentonite, synthetic calcium silicate, pumice and tricalcium phosphate may be substituted for a part, up to ½ of the insoluble bodying agents of the previous formulas. Preferably, the adjuvants of Example 1 (CMC, alkanolamide, pigment, optical brightener, dye and perfume) are included in the product of this example, in the proportions set forth in that example, or in similar proportions, but buffers, starches, and enzymes may also be used.

When the components of the formulas of this example are made into a 60% solids content crutcher mix, spray dried to bead form, and plodded and pressed, or such beads are pressed to cake form, a useful detergent laundry cake (or bar) is obtained but it usually will not possess the physical strength or smooth appearance and feel of the products of foregoing Examples 1–3.

This invention has been described with respect to examples and illustrations thereof but is not to be limited to these because it is evident that one of skill in the art, with the present specification before him, will be able to utilize substitutes and equivalents without departing from the invention.

What is claimed is:

1. A detergent laundry bar of good mildness, foaming properties for hand washing of laundry, and processing characteristics, consisting essentially of 10 to 30% of water soluble salt selected from the group consisting of alpha-sulfo-higher fatty acid-lower alcohol ester, alpha-sulfo-higher fatty acid amide, and mixtures thereof, 10 to 50% of builder for the detergent, a bodying proportion, in the range of 20 to 70%, of material selected from the group consisting of water insoluble powder, sodium sulfate filler, and mixtures thereof, and 5 to 20% of water, which water includes water removable from any hydrate components of the detergent laundry bar when such bar is subjected to heating at 105° C. for two hours.

2. A milled and plodded detergent laundry bar according to claim 1 consisting essentially of 15 to 25% of a water soluble salt selected from the group consisting of sodium salts of alpha-sulfo-higher fatty acid-lower alcohol esters, sodium salts of alpha-sulfo-higher fatty acid amides, and mixtures thereof, wherein the higher fatty acid is of 8 to 20 carbon atoms, the lower alcohol is of 1 to 4 carbon atoms, and the amide is a primary amide or is N-mono- or di-substituted by lower alkyl of 1 to 4 carbon atoms, 15 to 40% of water soluble inorganic builder salt, which salt is selected from the group consisting of alkali metal tripolyphosphate, alkali metal pyrophosphate, alkali metal carbonate and mixtures thereof, 20 to 50% of material selected from the group consisting of calcium carbonate, talc, sodium sulfate and mixtures thereof, and 7 to 17% of water.

3. A milled and plodded detergent laundry bar according to claim 2 consisting essentially of 15 to 25% of a water soluble salt selected from the group consisting of sodium alpha-sulfo-higher fatty acid-lower alcohol ester, sodium alpha-sulfo-higher fatty acid lower alkyl amide, and mixtures thereof, wherein the higher fatty acid is a mixture of fatty acids of carbon atom contents in the range of 8 to 20, the lower alcohol is of 1 to 3 carbon atoms, and the nitrogen of the amide is unsubstituted or is mono- or di-substituted by alkyl(s) of 1 to 3 carbon atoms, 5 to 35% of sodium tripolyphosphate, 0 to 25% of sodium carbonate, 0 to 10% of sodium silicate, 20 to 40% of a material selected from the group consisting of calcium carbonate, talc, sodium sulfate, and mixtures thereof, and 7 to 17% of water.

4. A milled and plodded detergent laundry bar according to claim 3 wherein the detergent is sodium-alpha-sulfo-higher fatty acid-lower alcohol ester and which bar comprises 18 to 22% of sodium alpha-sulfo-higher fatty acid-lower methyl ester, wherein the acid is a mixture of fatty acids of carbon atom contents in the range of 8 to 20, 8 to 20% of sodium tripolyphosphate, 5 to 15% of sodium carbonate, 2 to 5% of sodium silicate, 20 to 35% of calcium carbonate, 5 to 15% of talc and 10 to 15% of water.

5. A milled and plodded detergent laundry bar according to claim 4 consisting essentially of about 20% of sodium alpha-sulfo-higher fatty acid-lower methyl ester, wherein the acid is a mixture of fatty acids of carbon atom contents in the range of 8 to 20, about 12% of sodium tripolyphosphate, about 10% of sodium carbonate, about 4% of sodium silicate in which the Na20-:Si02 ratio is about 1:2.4, about 28% of calcium carbonate, about 11% of talc, about 2% of cocoethanolamide, and about 12% of water.

6. A milled and plodded detergent laundry bar according to claim 1 wherein the detergent is of the formula

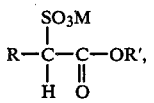

wherein R is higher fatty alkyl or alkenyl, R′ is lower alkyl and M is a cation.

7. A milled and plodded detergent laundry bar according to claim 3 wherein the detergent is sodium alpha-sulfo-higher fatty acid-lower alcohol ester.

8. A milled and plodded detergent laundry bar according to claim 1 wherein the detergent is of the formula

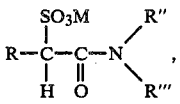

wherein R is higher fatty alkyl or alkenyl, R″ and R‴ are hydrogen and/or lower alkyl, and M is a cation.

9. A milled and plodded detergent laundry bar according to claim 3 wherein the detergent is sodium alpha-sulfo-higher fatty acid amide.

10. A millded and plodded detergent laundry bar according to claim 9 wherein the detergent is sodium alpha-sulfo-$C_{8-20}$ fatty acid primary amide.

11. A milled and plodded detergent laundry bar according to claim 10 wherein the detergent is sodium alpha-sulfo-$C_{8-20}$ fatty acid N,N-dimethyl amide.

12. A process for manufacturing a milled and plodded detergent laundry bar of a composition of claim 1 consisting essentially of pre-mixing together 10 to 30 parts of water soluble salts selected from the group consisting of alpha-sulfo-higher fatty acid-lower alcohol ester salts, alpha-sulfo-higher fatty acid-lower alkyl amide salts, and mixtures thereof, 10 to 50 parts of a builder for the detergent, a bodying proportion, in the range of 20 to 70 parts, of a material selected from the group consisting of water insoluble powder, sodium sulfate filler and mixtures thereof, all of which materials, with the exception of any sodium silicate solution present, being in finely divided particulate form, mixing said pre-mix with 5 to 20 parts of water, plodding the mixture, extruding it in bar form and cutting the bar to desired lengths.

13. A process according to claim 12 wherein sodium silicate, in aqueous solution, is admixed with the pre-mix before the water, and perfume is admixed with the pre-mix after the water, the mixture resulting is amalgamated and milled before plodding, the plodding is carried out under vacuum, and the cut lengths of the extruded bar are pressed to desired form.

14. A milled and plodded detergent laundry bar according to claim 1 which is a product of the process consisting essentially of pre-mixing together 10 to 30 parts of water soluble salts selected from the group consisting of salts of alpha-sulfo-higher fatty acid-lower alcohol esters, alpha-sulfo-higher fatty acid-lower alkyl amides, and mixtures thereof 10 to 50 parts of a builder for the detergent, a bodying proportion, in the range of 20 to 70 parts, of a material selected from the group consisting of water insoluble powder, sodium sulfate filler, and mixtures thereof, all of which materials, with the exception of any sodium silicate solution present, being in finely divided particulate form, mixing said pre-mix with 5 to 20 parts of water, plodding the mixture, extruding it in bar form and cutting the bar to desired lengths.

15. A milled and plodded detergent laundry bar according to claim 1 which is the product of the process consisting essentially of pre-mixing together 10 to 30 parts of a detergent which is a salt selected from the group consisting of water soluble salts of alpha-sulfo-higher fatty acid-lower alcohol esters, alpha-sulfo-higher fatty acid-lower alkyl amides, and mixtures thereof, 10 to 50 parts of a builder for the detergent, a bodying proportion, in the range of 20 to 70 parts, of material selected from the group consisting of water insoluble powder, sodium sulfate and mixtures thereof, and 2 to 5% of sodium silicate, in aqueous solution, all of which materials, with the exception of the sodium silicate solution, being in finely divided particulate form, mixing said pre-mix with 5 to 20 parts of water, followed by perfume, amalgamating and milling the mixture, plodding the amalgamated and milled mixture under vacum, extruding it in bar form, cutting the bar to desired lengths and pressing such lengths to desired form.

* * * * *